US008128542B2

(12) United States Patent
Hartman et al.

(10) Patent No.: US 8,128,542 B2
(45) **Date of Patent: *Mar. 6, 2012**

(54) EXERCISE GRIP DEVICE

(75) Inventors: James Hartman, Franklin, OH (US); Robert William Graham, Dayton, OH (US)

(73) Assignee: Grip4orce LLC, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/957,591

(22) Filed: Dec. 1, 2010

(65) Prior Publication Data

US 2011/0130257 A1 Jun. 2, 2011

Related U.S. Application Data

(63) Continuation-in-part of application No. 12/365,633, filed on Feb. 4, 2009, which is a continuation-in-part of application No. 12/025,163, filed on Feb. 4, 2008, now abandoned.

(51) Int. Cl.

| | |
|---|---|
| ***A63B 71/00*** | (2006.01) |
| ***A63B 23/16*** | (2006.01) |
| ***A63B 21/02*** | (2006.01) |

(52) U.S. Cl. ..... 482/139; 482/49; 482/122

(58) Field of Classification Search ..... 482/49, 482/106–108, 139, 122, 128; 24/499, 511, 24/20 S; 211/120; 16/411, 422, 435; 294/148, 294/166

See application file for complete search history.

(56) References Cited

U.S. PATENT DOCUMENTS

| | | | | |
|---|---|---|---|---|
| 2,239,180 | A * | 4/1941 | Kupfer | 135/72 |
| 3,326,550 | A | 6/1967 | Melchiona | |
| 3,541,990 | A * | 11/1970 | Mas | 441/69 |
| 4,588,191 | A * | 5/1986 | Stewart | 473/256 |

(Continued)

FOREIGN PATENT DOCUMENTS

| | | |
|---|---|---|
| WO | WO 9625339 | 8/1996 |

OTHER PUBLICATIONS http://www.lhpcombat.com/store/products.php?ProductID=102, Feb. 4, 2008.

(Continued)

*Primary Examiner* — Allana Lewin
(74) *Attorney, Agent, or Firm* — R. William Graham

(57) ABSTRACT

An exercise grip device for use on a handle of a sport instrument which is to be swung and has a predetermined exterior size and configuration for a predetermined sport of the type swung to strike an object, wherein the handle has a predetermined cross-sectional configuration includes a generally tube-like member with a lengthwise opening and having about hand-width to permit grasping thereabout with one's hand and wherein the tube-like member includes a spring aspect which is preformed to an open relaxed position has an inner surface having a cross-sectional configuration which is larger than the predetermined cross-sectional configuration of the handle and is compressible to a closed position where the inner surface is maintained in contact with the handle to exert a force on one's hand and arm muscles and wherein the surface includes a nonmetal material which in the closed position engages the handle to prevent sliding movement therebetween by virtue of a non metal to handle contact of the grip device with the handle and while engaged by one's hand in a continuous compressed manner prevents sliding movement through the non metal to handle contact and concurrently works one's hand and arm muscles throughout a swing exercise employing the device on the instrument.

7 Claims, 3 Drawing Sheets

U.S. PATENT DOCUMENTS

| | | | | |
|---|---|---|---|---|
| 5,415,607 | A * | 5/1995 | Carpenter | 482/106 |
| 5,514,055 | A | 5/1996 | Elliott | |
| 5,675,871 | A * | 10/1997 | Webb et al. | 24/20 R |
| 5,681,243 | A * | 10/1997 | Criss | 482/49 |
| 5,749,814 | A * | 5/1998 | Chen | 482/93 |
| 5,947,871 | A * | 9/1999 | Gilcrease | 482/49 |
| 6,604,789 | B1 * | 8/2003 | Downing | 297/227 |
| 6,813,974 | B2 * | 11/2004 | McCabe et al. | 81/64 |
| 6,898,802 | B1 * | 5/2005 | Suarkeo | 2/20 |
| 7,494,451 | B1 * | 2/2009 | Ramos | 482/107 |
| 7,736,284 | B1 * | 6/2010 | Andrews | 482/108 |
| 2001/0024999 | A1 * | 9/2001 | Pappert | 482/105 |
| 2006/0064851 | A1 * | 3/2006 | Kincaid | 16/435 |
| 2007/0238578 | A1 * | 10/2007 | Landfair | 482/44 |

OTHER PUBLICATIONS http://www.strengthcats.com/strengthequipment.htm—Feb. 4, 2008.

heavygrips.pdf, p. 1 Feb. 4, 2008.

* cited by examiner

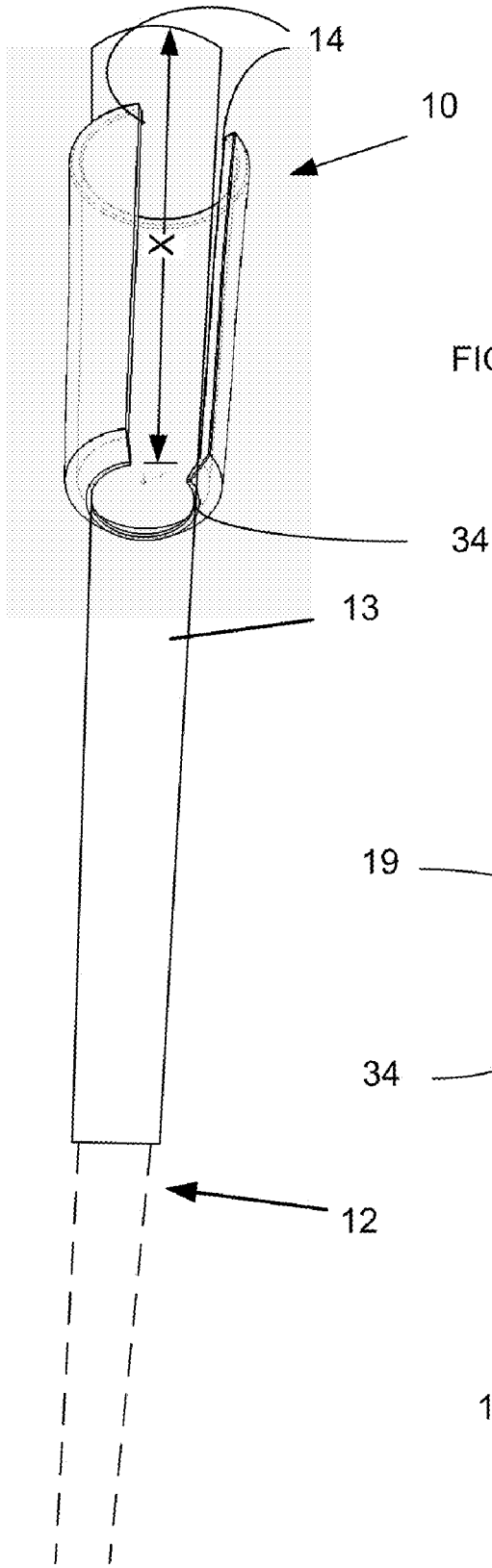
FIG. 1
FIG. 5
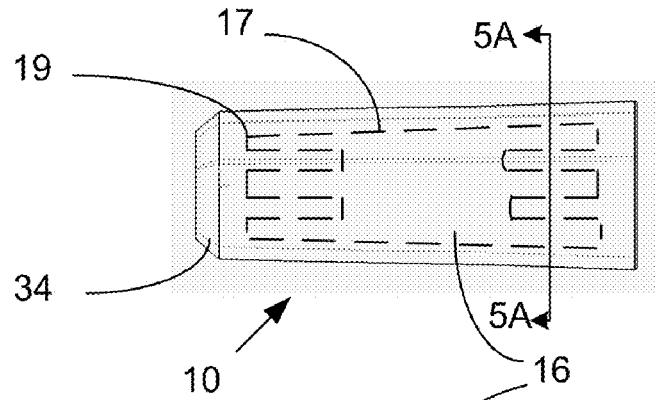
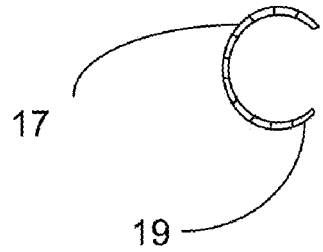
FIG. 5A

EXERCISE GRIP DEVICE

This is a continuation-in-part of U.S. Ser. No. 12/365,633 filed Feb. 4, 2009 which is a continuation-in-part of U.S. Ser. No. 12/025,163 filed Feb. 4, 2008 now abandoned.

BACKGROUND OF THE INVENTION

1. Field of the Invention

This invention relates to an exercise device, and more specifically, to a hand exercise grip device that easily connects about and is removed from a sport instrument. More particularly, this invention relates generally to a device and method of exercising by providing a grip strengthening device on a handle of a sport instrument which is swung by the user to work out various muscles in one's hands, arms and torso simultaneously.

2. Related Art

Time is valuable in the field of fitness training as most people feel the need to fit the maximum amount of workout in the minimum amount of time. Trainers are often employed to aid in this regard, particularly with persons attempting to stay at peak performance and fitness.

It is felt that the grip is of a primary importance in almost every sport. However, performing specific exercises for the grip tends to take additional time which people do not usually take in lieu of cardio or bulk muscle exercises and therefore goes overlooked. There are eighteen forearm muscles to be worked to increase grip strength.

Additionally, in certain sports, such as golf, tennis, baseball, softball, racquet ball, hockey, polo, jai alai, fencing, just to name a few, these sports typically employ the use of an instrument which is swung in order to hit an object. One's hand, grip, and arm strength is a key factor in performing the use of such instruments in an effective manner.

There exists exercise devices designed to help a user improve his or her grip strength and the muscles of the wrist and forearm. One such device fits within a user's hand and is squeezed by the user. Another device is a hand exerciser that has one or more springs or elastic bands attached to a base and the user applies force to stretch the springs/bands with his or her fingers.

As to particular sport applications, a conventional Y shaped squeezer grip exercise is not preferred because there is no useful implementation for building proper muscle and muscle memory with such instruments. Thus, there remains a need to improve grip, strength, stability, and technique for such instruments.

Grip stability correlates to one's resistance of unwanted instrument motion while handling the instrument, i.e., motion caused from forces exerted from the instrument swung. It thus requires working your hand, wrist and arm in various planes of motion while building strong stability. Until the present invention, no suitable device existed to achieve this. The present invention overcomes these deficiencies in the art.

SUMMARY OF THE INVENTION

It is another object to improve the field of exercising.

Still another object is to improve grip stability.

It is a further object to provide a device for increasing grip and arm strength.

It is another object to provide a device which permits enhanced exercises to be performed by providing a grip strengthening device on a handle of a sport instrument which is swung by the user to work out various muscles in one's hands, arms and torso simultaneously.

It is still another object to provide a method of training which exercises one's hand and forearm muscles during exercises which employ a sport instrument which is used in striking an object.

Accordingly, in one embodiment, the invention is directed to an exercise grip device for use on a handle of a sport instrument which is to be swung and has a predetermined exterior size and configuration for a predetermined sport of the type swung to strike an object, wherein the handle has a predetermined cross-sectional configuration. The device includes a generally tube-like member with a lengthwise opening and having about hand-width to permit grasping thereabout with one's hand and wherein the tube-like member includes a spring aspect which is preformed to an open relaxed position and has an inner surface having a cross-sectional configuration which is larger than the predetermined cross-sectional configuration of the handle and is compressible to a closed position where the inner surface is maintained in contact with the handle to exert a force on one's hand and arm muscles and wherein the surface includes a nonmetal material which in the closed position engages the handle to prevent sliding movement therebetween by virtue of a non metal to handle contact of the grip device with the handle and while engaged by one's hand in a continuous compressed manner prevents sliding movement through the non metal to handle contact and concurrently works one's hand and arm muscles throughout a swing exercise employing the device on the instrument. The cross-sectional configuration can include cylindrical or irregular ring, rectangular, square, multisided polygon including sides having equal or unequal lengths.

A method of exercising training using a sport instrument having a handle having a predetermined exterior size and configuration for a predetermined sport of the type swung to strike an object, wherein the handle has a predetermined cross-sectional configuration, which includes the steps of:

(a) providing about the handle a device which includes a generally tube-like member with a lengthwise opening and having about hand-width to permit grasping thereabout with one's hand and wherein said tube-like member includes a spring aspect which is preformed to an open relaxed position having an inner surface having a cross-sectional configuration which is larger than the predetermined cross-sectional configuration of the handle and is compressible to a closed position where the inner surface is maintained in contact with the handle to exert a force on one's hand and arm muscles and wherein the surface includes a nonmetal material which in the closed position engages the handle to prevent sliding movement therebetween by virtue of a non metal to handle contact of the grip device with the handle;

(b) compressing the device by one's hand in a continuous manner to cause the device to engage the handle to prevent sliding movement between the device and handle through the non metal to handle contact; and (c) while the device is engaged with the handle swinging the instrument to concurrently work one's hand and arm muscles.

Further aspects of the invention are evident from the Detailed Description of the Preferred Embodiments.

BRIEF DESCRIPTION OF THE DRAWINGS

FIG. 1 is a perspective view of an embodiment of an exercise grip device of the present invention about a sport instrument in an open uncompressed state;

FIG. 5 is a side view of the exercise grip device.

FIG. 5A is a cross section through line 5A-5A of FIG. 5 illustrating the spring.

DETAILED DESCRIPTION OF PREFERRED EMBODIMENTS

The invention is described in detail as preferred embodiments with the understanding that the present disclosure is to be considered as an exemplification of the principles of the invention and is not intended to limit the broad aspect of the invention to the embodiment illustrated. The exercise grip device 10 of the present invention solves the problems associated with the prior art by providing the exercise grip device 10 which enables multiple and concurrent exercises of the hands, arms and torso while providing a secure grip when using a sport instrument 12. The exercise grip device 10 is portable and easily connected to and removed from the sport instrument handle 13 which is to be swung.

The exercise grip device 10 is used in connection with a sporting instrument 12 to provide an improved exercise method and device for performing concurrent exercises in one's hands, arms and torso simultaneously. It is contemplated that exercise grip device 10 can be used as a stand alone piece of equipment for exercising one's hands and forearms.

The exercise grip device 10 includes jaw members 14 which are shown here as opposing generally arc shaped members and can be formed as part of a single piece material construction. The exercise grip device 10 is of a length L about a hand-width to permit grasping thereabout.

Figure 6:
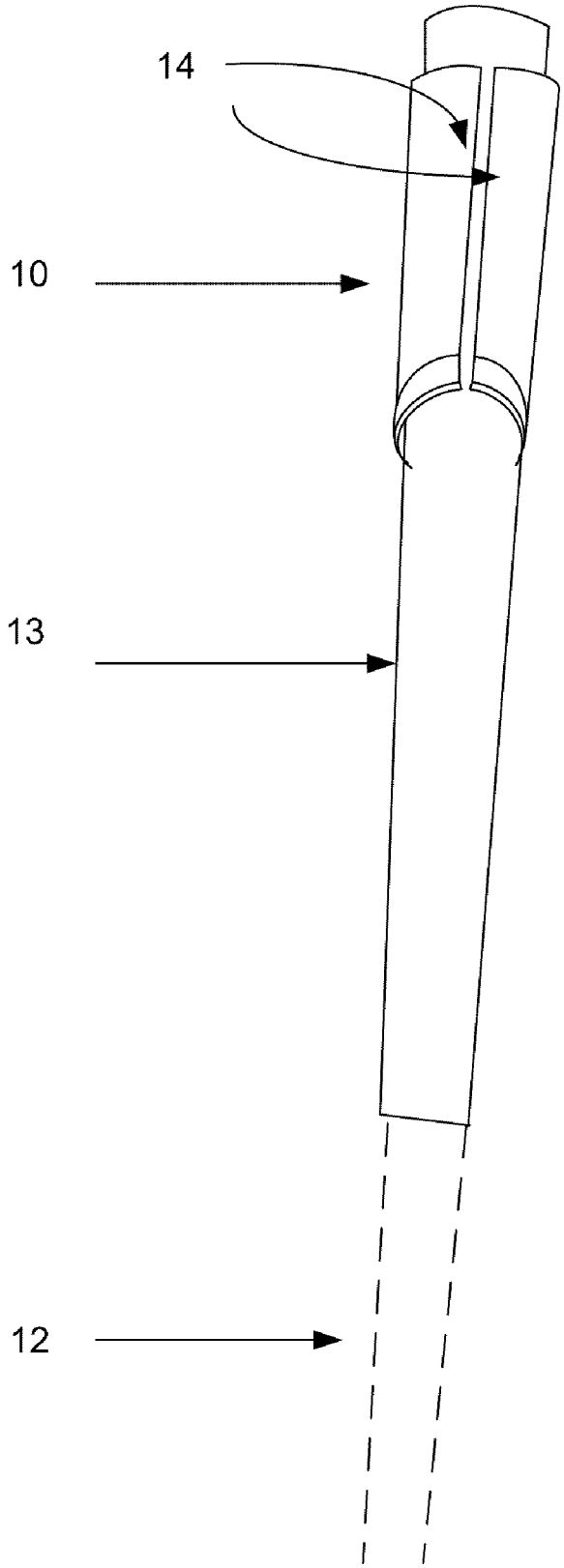
FIG. 6 is a perspective view of the exercise grip device disposed around the handle in a closed position and compressed position.

The jaw members 14 can include a spring element 16 which is preformed to an open position as seen in FIG. 1-5 to permit insertion of a sporting instrument bar 12 therethrough, which is here depicted as a golf shaft 12 with handle grip 14. The jaw members 14 and spring element 16 are compressible to a closed position as seen in FIG. 6 enabling engagement of the jaw members 14 with the handle 13 and with the device 10 having a non-slip surface connection to prevent sliding movement therebetween. While compressed, the exercise grip device 10 exerts a force on one's hand and forearm muscles.

In a preferred embodiment, the jaw members 14 can comprise an outer covering 15 made of a rubber, latex or polyfoam material, for example which aids in the non-slip connection, and the spring element 16 (as seen in FIG. 5 with hidden lines and FIG. 5A) which can include a polymer spring, such as a polypropylene and nylon composition or spring metal formed therein. The spring 16 which can be inserted into a mold in a manner to be held centrally such that outer covering 15 is formed by injecting uncured material about the spring 16 wherein it cures about the spring 16.

Optionally, rubber or other polymer can also be formed in a manner as a composite laminate to delivery memory to perform the invention as a single component. The jaw members 14 can be formed with arcuate surface or other desirable surface configuration which lends itself to use on the intended sport instrument 12. A lengthwise opening 18 readily permits at least a portion of the handle 13 and shaft 12 to pass in and out therethrough.

In the shown embodiment, the device 12 can be configured for use with golf grip handle 13 on club 12. The device 10 in this case is tapered with end 30 larger than end 32 to conform to a portion of the grip handle 13. In this example, the exercise grip device 10 can be relatively thin in its cross section as illustrated by thickness T in FIG. 4, which can be for example from about $1/16^{th}$ to $3/16^{th}$ inch thickness, to provide a comfortable grip on the handle 13 when used by one hand while the other hand is able to placed normally on the grip and thereby permit a relatively conventional grip feel for the particular instrument 12, or club, to be assumed.

Also, the end 32 can have a radially inwardly extending collar 34 which is pitched or tapered axially outward. This collar 34 can preferably be of a flexible material, such as a continuing portion of the outer covering 15 which can be a rubber, for example, and defines an inner diameter D1 which is of a predetermined amount to be about equivalent to a diameter portion of the grip handle 13 at a predetermined length X from the end of the handle 13. In this regard, the collar 34 serves as a locator for positioning the device 10 at a part of the grip 13 where the device 10 is to be used for purposes of training. The collar 34 can preferably readily collapse and the device 10 can be compressed such that inner gripping surface 22 can contact the handle grip 13 and provide secure grip to the instrument 12.

With this embodiment, the exercise grip device 10 can have an in use diameter thickness of slightly larger diameter than the conventional handle grip 13 which in the case of a golf grip runs from about 0.6 inch to about 1 inch. In this embodiment, the device 10 is of about a hand width, and can be slightly less. For youth to adults the width can be several inches up to about four inches for applied to a single hand usage. It is contemplated that if the device 10 is for use on another sport wherein both hands are to be applied to the sport instrument, it may be preferable to extend the width of the device for such application. For example, in the case for baseball it may be preferable to have the device formed in a manner to complementary receive the handle of a bat when compressed. The interface of the device 10 can preferably provide a nonmetal to handle 13 interface to prevent slipping when using the sporting instrument 12. It is recognized that the thickness can be varied to accommodate user preference. Additionally, the amount of resistance can be varied to accomplish a particular training exercise. In the case of golf, it is desirable to maintain a firm grip of the club with one's hand (top hand on golf club), particularly the last two fingers and thumb, throughout swinging the club. Professionals typically look for wear on the palm of the glove which indicates that the person is relaxing, releasing and regripping the club's handle grip. Thus, the instant device 10 is preformed with enough spring force to make the user aware that he/she must maintain the device 10 compressed and closed position on the handle 13 to avoid letting go of the club. One can practice hitting balls and aids in building proper muscle memory and strength in one's fingers, hands, wrist, arms and torso.

Figure 2:
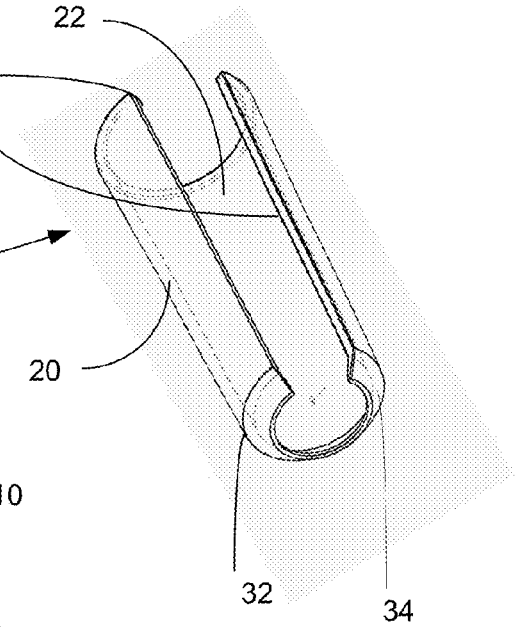
FIG. 2 is another perspective view of the device.
Figure 3:
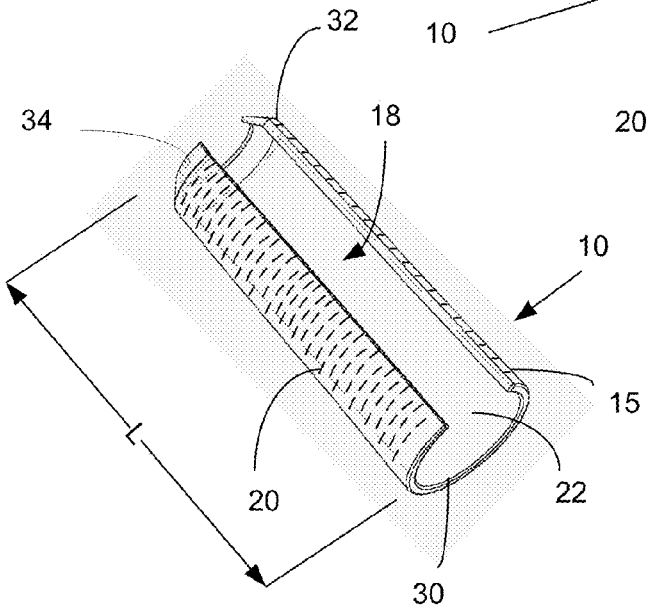
FIG. 3 is yet another perspective view of the device.
Figure 4:
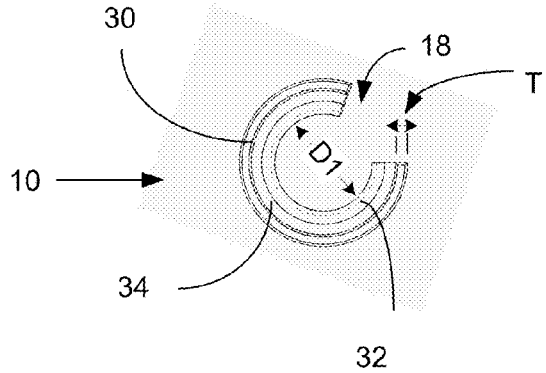
FIG. 4 is an end view of the device shown in FIG. 3 taken from the large end.

The outer covering 15 can serve as a pad having an outward gripping surface 20 and an opposing inner bar gripping surface 22. The outer covering 15 can be textured (as seen in FIG. 3) for functional an aesthetic purposes. The outer covering 15 and spring 16 can be formed from in varying amount of compressibility and spring force to accommodate user preferences. For example, natural or synthetic rubber or polyfoam can be used. It is envisioned that as applied to a sporting instrument handle 13, one or two exercise grip devices 10 can be used.

A method of exercising training using a sport instrument having a handle having a predetermined exterior size and configuration for a predetermined sport of the type swung to strike an object, wherein the handle has a predetermined cross-sectional configuration, which includes the steps of:

(a) providing about the handle a device which includes a generally tube-like member with a lengthwise opening and having about hand-width to permit grasping thereabout with one's hand and wherein said tube-like member includes a spring aspect which is preformed to an open relaxed position having an inner surface having a cross-sectional configuration which is larger than the predetermined cross-sectional configuration of the handle and is compressible to a closed position where the inner surface is maintained in contact with the handle to exert a force on one's hand and arm muscles and wherein the surface includes a nonmetal material which in the closed position engages the handle to prevent sliding movement therebetween by virtue of a non metal to handle contact of the grip device with the handle;

(b) compressing the device by one's hand in a continuous manner to cause the device to engage the handle to prevent sliding movement between the device and handle through the non metal to handle contact; and (c) while the device is engaged with the handle swinging the instrument concurrently work one's hand and arm muscles.

The embodiment seen in FIGS. 5 and 5A modify the spring element 16 into a skeleton having a spine 17 and appendages 19. The appendages 19 can include a recessed surface edge as disclosed in prior parent applications to aid for a self retaining mechanism to keep the spring element 16 in position in its surrounding molded covering 15. Optionally, the appendages 19 can be omitted or of a length to accomplish the desired resistance. It is contemplated that the spring 16 can be thermally bonded to outer covering 15 wherein the thermoformed laminate aids in providing some of the resistance. Thus, it is contemplated that the spring 16 can and outer covering 15 can be so formed with such natural or synthetic rubber and polymer material which can provide a desired resistance. In the case where element 16 is molded to be at least partially exposed this feature is exemplified. It is contemplated that the orientation of the spring 16 relative to the covering 15 can be varied. An exemplary version contemplates a non-metal inner gripping surface 22 which in the case of a laminate could comprise the spring material. The outer gripping surface 20 can be of a tread design to enhance hand grip. However, the element 16 can be recessed within the outer covering 15. Further, the spring 16 provides for not only strength but also flexibility in the overall product and enables various materials to be employed to carry out this aspect such as nylon, polypropylene or polymer blend or spring steel, for example, within a natural or synthetic rubber outer cover.

By employing the instant invention, the problem of developing proper grip stability is better achieved. Better form in performing the use of the particular sporting instrument can be achieved. The invention provides for enhanced development of grip stability, grip, wrist, elbow, shoulder, chest and latissimus dorsi. A benefit of the invention is that the enhanced grip stability and overall strength will lead to better endurance and decreased fatigue which would otherwise be caused by high levels of lactic acid which provide hydrogen ions causing the forearm to shut down.

While specific embodiments have been illustrated and described, numerous modifications come to mind without markedly departing from the spirit of the invention. The invention covers a tube-like member having an opening running axially lengthwise wherein the tube-like member can be formed with a spring material and take on geometric shapes which are suitable for practicing the invention. The scope of protection is thus only intended to be limited by the scope of the accompanying claims. Thus, the breadth and scope of the present invention should not be limited by any of the above described exemplary embodiments, but should be defined only in accordance with the following claims and their equivalents.

What is claimed is:

1. An exercise grip device for use on a handle of a sport instrument which is to be swung and has a predetermined exterior size and configuration for a predetermined sport of the type swung to strike an object, wherein the handle has a predetermined cross-sectional configuration, which includes:

a generally tube-like member with a lengthwise opening defined between two ends and wherein said member has a width to permit grasping thereabout with one's hand and wherein the tube-like member includes a curved spring having an opening defined therein which is preformed to an open relaxed position having a relaxed inner diameter and has an inner surface having a cross-sectional configuration which is larger than the predetermined cross-sectional configuration of the handle when disposed thereabout and is compressible to a closed position without interference by said ends such that said tube-like member ends are adjacent one another and said tube-like member assumes an inner diameter substantially that of said handle and which is less than the relaxed inner diameter which is about a diameter of the bar where said inner surface is maintained in contact with the handle to exert a force on one's hand and arm muscles and wherein said inner surface includes a non-metal material which in the closed position engages the handle to prevent sliding movement therebetween by virtue of said non-metal inner surface to handle contact of said exercise grip device with the handle and while engagable by one's hand in a continuous compressed manner prevents sliding movement through said non-metal inner surface to handle contact and concurrently works one's hand and arm muscles throughout a swing exercise employing said grip exercise device on the instrument.

2. The exercise grip device of claim 1, wherein said tube-like member includes a spring and one of an outer rubber and polyfoam covering formed therewith.

3. The exercise grip device of claim 1, wherein said inner surface cross-sectional configuration includes a shape of one of a cylindrical, an irregular ring, and a multisided polygon including sides having one of equal or unequal lengths.

4. The exercise grip device of claim 1, wherein said exercise grip device is connected to a handle of the sporting instrument.

5. The exercise grip device of claim 2, wherein said outer covering forms a pad having an outward gripping surface and an opposing inner gripping surface.

6. The exercise grip device of claim 2, wherein said outer covering includes one of a smooth and textured surface.

7. The exercise grip device of claim 1, wherein said spring includes a skeleton having a spine and appendages.

* * * * *